US008672471B2

(12) United States Patent
Kawashima

(10) Patent No.: US 8,672,471 B2
(45) Date of Patent: Mar. 18, 2014

(54) FEEDING APPARATUS

(75) Inventor: Hideki Kawashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 13/188,298

(22) Filed: Jul. 21, 2011

(65) Prior Publication Data

US 2012/0026265 A1 Feb. 2, 2012

(30) Foreign Application Priority Data

Jul. 29, 2010 (JP) ..... 2010-170798

(51) Int. Cl.
*B41J 2/01* (2006.01)

(52) U.S. Cl.
USPC ..... 347/104; 347/101

(58) Field of Classification Search
USPC ..... 271/225; 347/19, 101, 104; 399/405; 400/208.1
See application file for complete search history.

(56) References Cited

U.S. PATENT DOCUMENTS

| | | | | |
|---|---|---|---|---|
| 2005/0046658 | A1* | 3/2005 | Kojima | 347/19 |
| 2009/0108517 | A1* | 4/2009 | Guerand et al. | 271/225 |
| 2009/0324314 | A1* | 12/2009 | Tanabe et al. | 400/208.1 |
| 2010/0061787 | A1* | 3/2010 | Katayama | 399/405 |

FOREIGN PATENT DOCUMENTS

| | | | |
|---|---|---|---|
| CN | 101578181 | A | 11/2009 |
| JP | 11-011750 | A | 1/1999 |
| JP | 2006-306511 | A | 11/2006 |

* cited by examiner

*Primary Examiner* — Manish S Shah
*Assistant Examiner* — Yaovi Ameh
(74) *Attorney, Agent, or Firm* — Canon USA Inc IP Division

(57) ABSTRACT

A feeding apparatus for roll paper that enables downsizing and a stable feeding of a printer pressurizes a roll paper shaft to press-contact with a feeding roller, and thereafter, drives the feeding roller to feed the paper, and urges a pick-up guide to contact an outer circumference of the roll paper. In a feeding mechanism for picking up the leading edge of the roll paper, a tip end of the pick-up guide rotates in a direction to widen a paper conveyance path as a remaining amount of the roll paper becomes less, and a part of the pick-up guide moves to a direction to approach the roll paper to be conveyed or a direction to urge the roll paper according to the rotation of the pick-up guide.

11 Claims, 8 Drawing Sheets

FEEDING APPARATUS

BACKGROUND OF THE INVENTION

1. Field of the Invention

The present invention relates to a feeding apparatus, more specifically, relates to a feeding apparatus for feeding roll paper.

2. Description of the Related Art

Recently, digital cameras have been widely used to capture many images. In order to print the many pieces of image data effectively, it is becoming necessary to print more sheets within a shorter time period and to eliminate the job of cutting a margin of a printed product. Therefore, increasing the rate of printing and a marginless of the printed product are required, not only for professional use printers, but also for a house hold use printer. In view of the above, a roll paper type printer comes to be employed also in the house hold use printer and thus a paper feeding mechanism for the roll paper is required also in the house hold use printer.

Conventionally, a method for causing a user to insert a leading edge of the roll paper into, or pinch the leading edge of the roll paper, a paper feeding roller or a paper guide is generally known as a roll paper loading method. Recently, such a method is frequently used, as a paper feeding mechanism of the roll paper that does not place a burden on a user, that the roll paper in which a roll paper shaft is inserted is loaded into a paper feeding unit, and a seal for sealing a leading edge of the roll paper is removed to complete the loading processing. The roll paper shaft loaded by the user is pressed against the paper feeding roller using a pressurizing mechanism provided on a printer main body or the feeding apparatus in order to cause the paper feeding roller to contact with an outer circumference of the roll paper under pressure and to cause the paper feeding roller to rotationally drive in a sheet feeding direction to rotate the roll paper. Then, a paper feeding mechanism that picks up a leading edge of the outermost circumference of the roll paper by a pick-up member to feed the roll paper is used.

For example, Japanese Patent Application Laid-Open No. 2006-306511 discusses a cassette including an urging mechanism for urging a roll paper on a paper feeding roller and a pick-up member contactable with the outer circumference of the roll paper in order to pick up the leading edge of the roll paper. Japanese Patent Application Laid-Open No. 2006-306511 further discusses a mechanism for extracting the roll paper by picking up the leading edge of the roll paper according to a press-contact rotation of the paper feeding roller after the roll paper is loaded to a main body. According to the mechanism, the roll paper shaft is movable in a direction toward the paper feeding roller even with a small amount of remaining roll paper after the roll paper is withdrawn, so that the roll paper can be stably fed while an unrolling of the roll paper is controlled. Even in a case where an entire length of the roll paper becomes longer and thus the roll paper itself becomes heavier, which tends to exert an adverse effect in feeding paper, a pick-up operation can be stably performed by a positional relationship in a vertical direction between a pick-up guide and the roll paper being set such that a tip end of the pick-up guide is positioned above the rotational shaft of the roll paper.

In Japanese Patent Application Laid-Open No. 11-11750, the roll paper is rotatably supported and the pick-up guide for separating the leading edge of the roll paper is urged such that the pick-up guide contacts the outer circumference of the roll paper. The tip end of the pick-up guide is always positioned on the outer circumstance of the roll paper following a change of an outer diameter of the roll paper. The roll paper is rotatably driven, the picked up leading edge of the roll paper passes between an outer circumferential guide member and the pick-up guide, and the roll paper is conveyed from the outer circumferential guide member to a paper guide board positioned at a downstream side of the outer circumferential guide member. In order for the leading edge of the roll paper to be securely guided to a paper guide board, a distance in a sheet thickness direction of an opening portion of the paper guide board is made wider than a distance of an exit formed between the pick-up guide and the outer circumferential guide member. Further, a slope that is gentle in an up-and-down direction is provided to enable guiding of the leading edge of the roll paper to the downstream side.

A smaller size is desired in a field of the house hold use printer. However, in the above described conventional art, the leading edge of the roll paper is guided by the paper guide for conveying the roll paper from the paper feeding unit to a print unit, which adversely effects on downsizing of the printer. In a case where an inner diameter of the roll paper is made smaller for the purpose of downsizing of the printer, a curling degree that the roll paper originally has and an amount of change in the curling degree between the innermost circumference portion and the outermost circumference portion become larger. Therefore, when the roll paper is conveyed from the pick-up guide member to the print unit, a position of the leading edge of the roll paper varies according to an adverse effect of the diameter and/or the curling degree. Therefore, it is required to guide the varied positions of the leading edge to a desirable sheet feeding direction so as to avoid jamming of the roll paper. The diameter of the roll paper becomes smaller as the number of sheets of the feeding paper becomes larger. Thus, the curling degree of the roll paper is the smallest in the start of using the roll paper and becomes gradually larger as using the roll paper. The positions of the leading edge of the roll paper coming out through a guiding surface of the pick-up guide according to the curling degree of the roll paper also change gradually. In order to securely guide the leading edge of the roll paper thus varied, a paper guide having a gentle slope is required.

FIG. 8A illustrates a conventional example of a paper feeding unit including a paper guide. In a case where the paper feeding unit includes the paper guide, an installation space is required for an installation surface and prevention of deformation of the paper guide. As illustrated in FIG. 8A, since a paper guide 801 is provided on the paper feeding unit, a distance between a roll paper accommodating unit 802 and a pinch roller 803 and a grip roller 804 for conveying the paper during printing cannot be closer. Therefore, there is an issue in downsizing the paper feeding unit.

If the paper guide 801 is eliminated, when an end of the roll paper having smaller diameter is fed, as illustrated in FIG. 8B, the curling degree of the roll paper becomes larger. With a shape of the conventional pick-up member 805, the leading edge of the roll paper curls up after the roll paper passes through a rotational center 805*a*. There is an issue that the roll paper comes into a space between the pick-up member 805 and the pinch roller 803 to disable the guiding of the leading edge to a space between the pinch roller 803 and the grip roller 804. To realize downsizing without impairing a paper feeding function is the issue to be solved.

SUMMARY OF THE INVENTION

The present invention is directed to a feeding apparatus capable of stably feeding paper without adding parts, such as a paper guide, for example.

According to an aspect of the present invention, a feeding apparatus includes an accommodating unit configured to accommodate roll paper, a pick-up guide configured to pick up a leading edge of the roll paper by contacting an outer circumference of the roll paper, an urging unit configured to urge a tip end of the pick-up guide in a direction that the tip end contacts the outer circumference of the roll paper, and a paper feeding unit configured to pick up the leading edge of the roll paper with the pick-up guide and to feed the roll paper from the accommodating unit by rotating the roll paper, wherein the pick-up guide rotates since an outer diameter of the roll paper becomes smaller according to a remaining amount of the roll paper, and a rear end of the pick-up guide moves in a direction to narrow a conveyance path of the roll paper picked up by the pick-up guide.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An exemplary embodiment of the present invention is described below in detail with reference to FIGS. 1 through 6.

Figure 1:
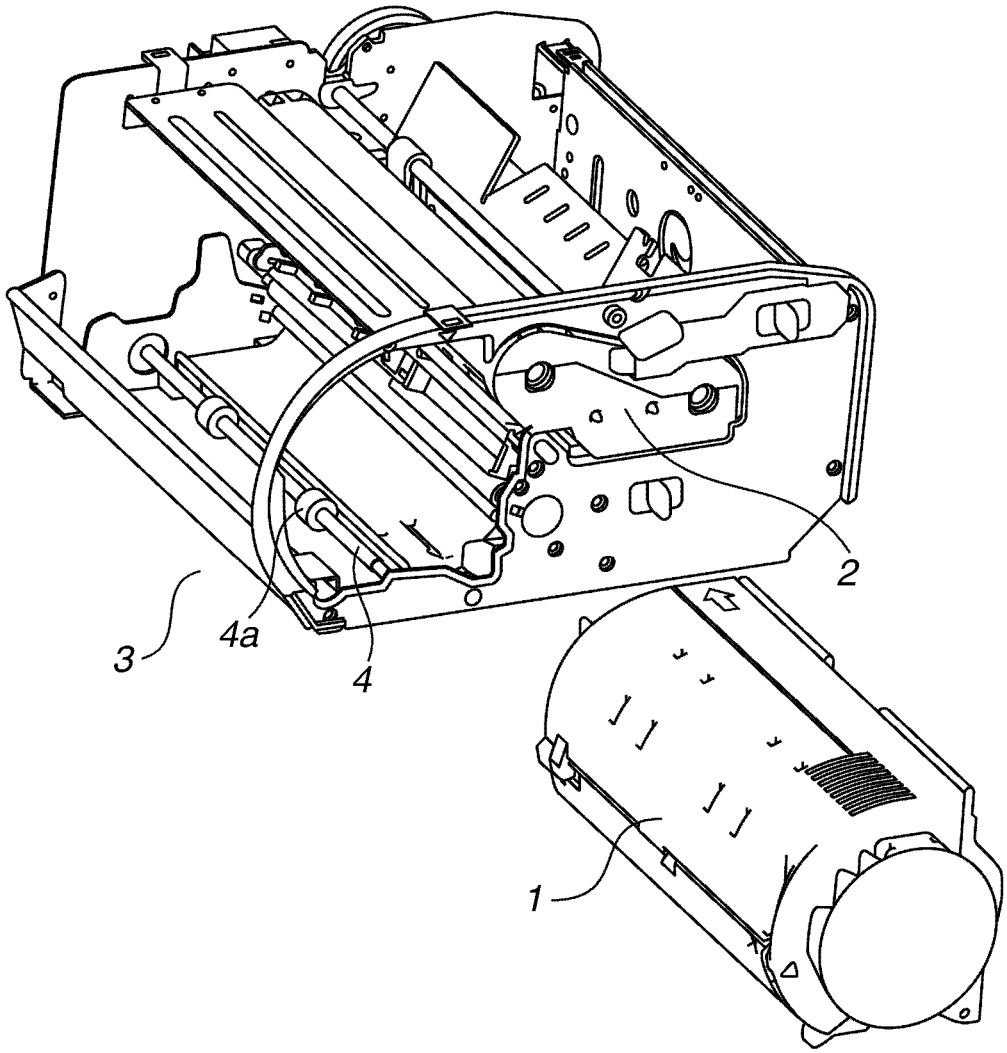
FIG. 1 is a perspective view illustrating a printer and a roll paper cassette according to an exemplary embodiment of the present invention.

FIG. 1 is a perspective view illustrating a printer and a roll paper cassette according to the exemplary embodiment of the present invention.

A roll paper cassette 1 and an ink ribbon cassette 2 are detachable from a printer main body 3 and are shown in a state of being loaded into the printer main body 3 when printing is performed. The printer illustrated in the present exemplary embodiment is a sublimation type printer that uses ink ribbons and roll paper.

In order to perform a color printing on a sheet of paper, the ink ribbons of dye inks of yellow, magenta, and cyan are arranged in this order. The paper is reciprocatively, or repetitively conveyed in a printing operation for a sheet of paper to repeat printing for a plurality of times, thus the inks of yellow, magenta, and cyan are overglazed to form a color image. Accordingly, the inks of yellow, magenta, and cyan of areas corresponding to one sheet of the paper are consumed in the printing operation for the sheet of paper. Therefore, if the printing of an image extremely different in a print size is performed, roll paper and ink ribbons having widths for exclusive use for the print size are prepared and it is convenient if they can be exchanged during the printing operation. In the present exemplary embodiment, the roll paper and the ink ribbons, respectively, are accommodated in cassettes to be detachable to enable a user to perform printing conveniently and with less waste.

The roll paper cassette 1, formed into a cassette configuration, accommodates the roll paper to be used in printing, so that the roll paper cassette 1 can be stored while safely protecting the roll paper when the roll paper is not in use. The ink ribbon cassette 2 is illustrated in a state that an unused ink ribbon is wound to one of the bobbins. Printing is performed while the unused ink ribbon is wound by one of the bobbins during printing. The ink ribbon cassette 2 also functions to protect the ink ribbons. The ink ribbon cassette 2 is configured to prevent the ink ribbons from being contaminated with dust, and tearing, and to prevent the inks from deteriorating during storage by covering the ink ribbons as much as possible.

Since the printer main body 3 includes a cassette stopper lock for each of the roll paper cassette 1 and the ink ribbon cassette 2, the roll paper cassette 1 and the ink ribbon cassette 2 can be exchanged individually. The roll paper cassette 1 and the ink ribbon cassette 2 are detachable in a direction orthogonal to a conveyance direction of the roll paper when it is fed.

A paper feeding roller 4 is used in feeding the roll paper after printing has initiated and is movable between a standby position and a paper feeding position by a driving unit (not shown). When the roll paper cassette is loaded, the paper feeding roller 4 moves to the standby position. The standby position is a retracting position at which a rubber roller unit 4*a* does not come into contact with the roll paper when the roll paper cassette 1 is loaded. The paper feeding roller 4 moves to a position where the paper feeding roller 4 contacts the roll paper loaded in the roll paper cassette 1. The roll paper cassette 1 is under pressure when the print operation is started. Further, when feeding the roll paper, the paper feeding roller 4 is rotatably driven by the driving unit.

Figure 2:
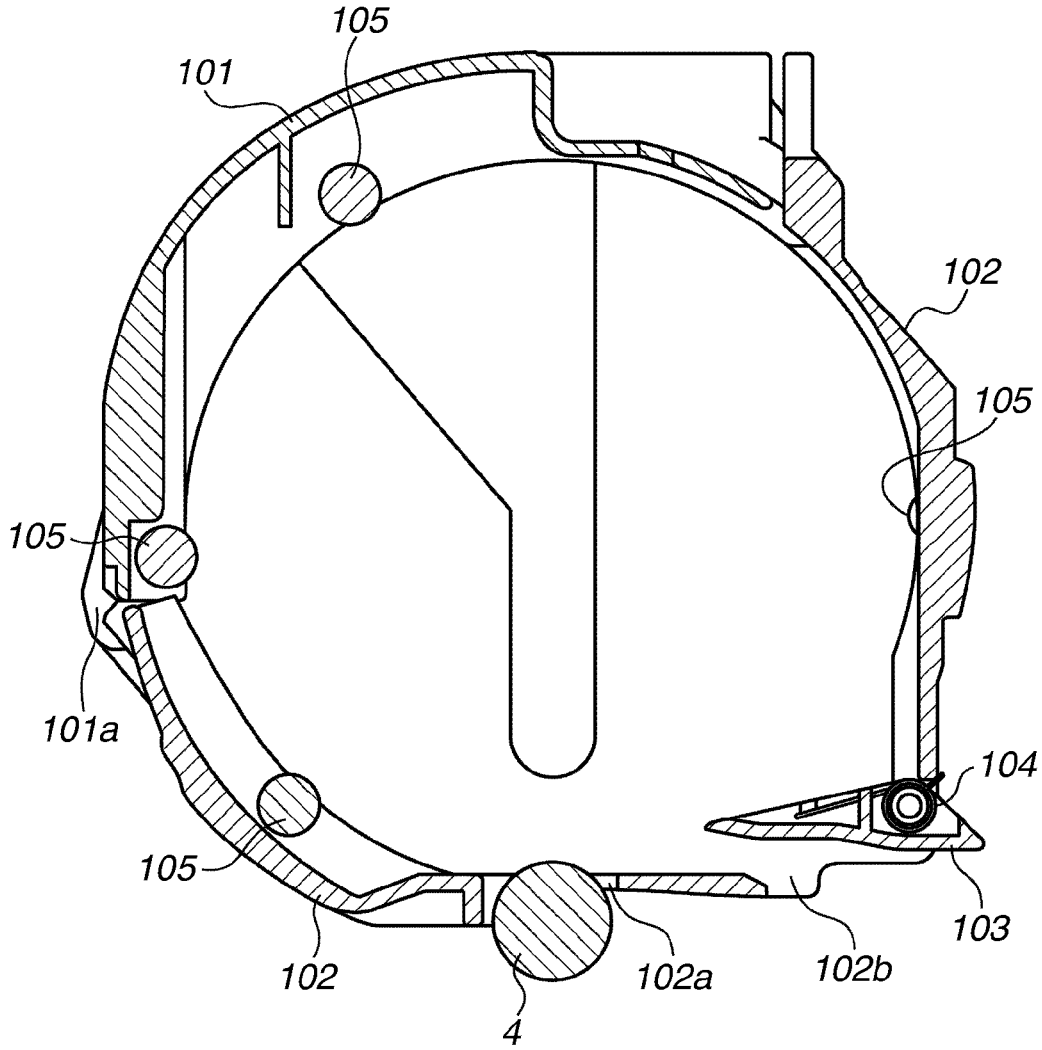
FIG. 2 is a cross sectional view of the roll paper cassette according to the exemplary embodiment of the present invention.

FIG. 2 is a cross sectional view of the roll paper cassette 1 according to the exemplary embodiment of the present invention. For reference, a position of the paper feeding roller 4 at the time of feeding the roll paper is also illustrated. The roll paper cassette 1 includes an upper case 101 and a lower case 102 and is openable and closable (i.e. able to pivot) around a portion 101*a* that functions at least as a hinge. Ribs are provided on inner surfaces of the respective cases to reduce a resistance in conveying the roller paper. Reducing the resistance also facilitates rotation and feeding of the roll paper. In a case of further reducing a conveyance resistance (i.e. the resistance associated with conveying), small drive rollers 105 can be mounted on the inner surfaces of the cases 101, 102.

An opening portion 102*a* and a roll paper leading edge exit 102*b* are provided in the lower case 102 for enabling the paper feeding roller 4 to abut the roll paper when feeding the roll paper. The roll paper leading edge exit 102*b* of the lower case 102 has a shaft configuration for supporting a pick-up guide 103 in an integral and rotatable manner. An urging spring 104 is provided on a center of the pick-up guide 103, so that a tip end 103*c* of the pick-up guide 103 is urged to an interior direction of the lower case 102, i.e., in a direction the tip end 103*c* contacts an outer circumference of the roll paper. The urging spring 104 may be, for example, a torsional spring 104. The urging direction of the pick-up guide 103 is described below in detail with reference to FIG. 3.

Figure 3:
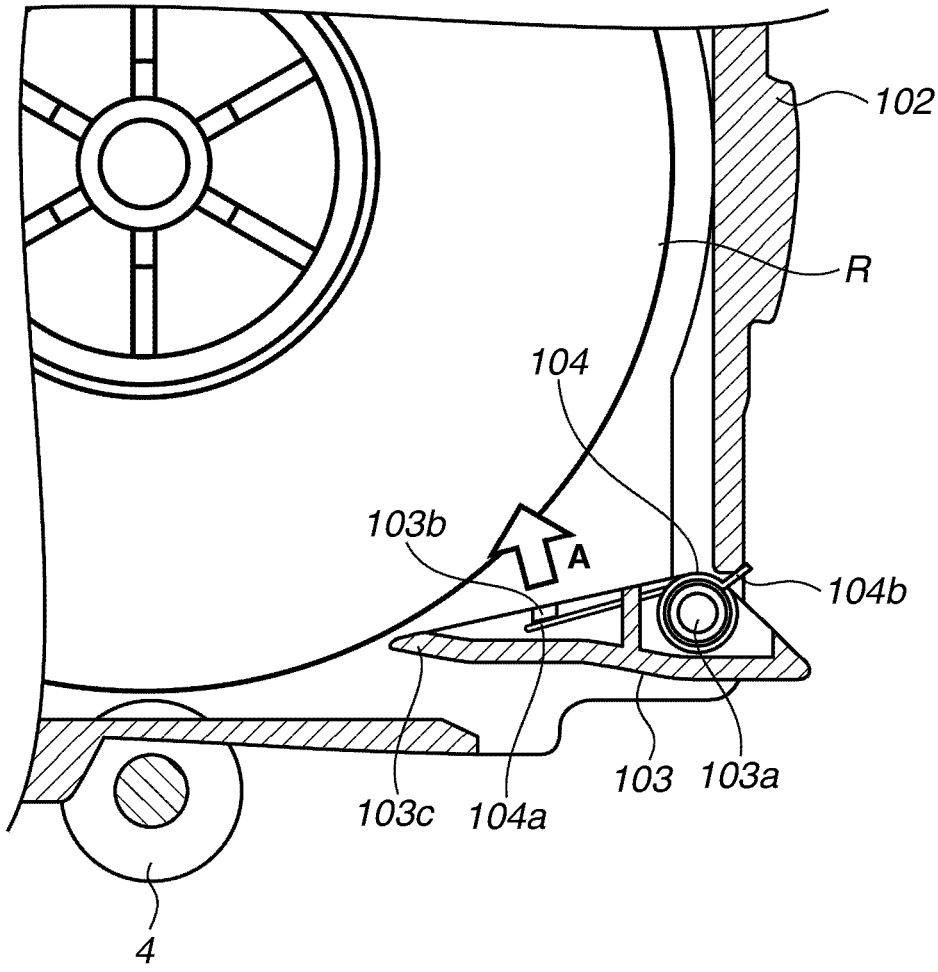
FIG. 3 is a cross sectional view illustrating a relationship between a pick-up guide and an urging spring according to the exemplary embodiment of the present invention.

FIG. 3 is a cross sectional view illustrating a relationship between the pick-up guide 103 and the urging spring 104 according to the exemplary embodiment of the present invention. The urging spring 104 may be a torsional coil spring, as shown, attached to the shaft 103*a* provided on the pick-up guide 103. An urging spring fixing end 104*b* is latched to the lower case 102 and an urging spring moving end 104*a* contacts a projection 103*b* of a latching portion provided on the pick-up guide 103 causing an urging force of the urging spring 104 to be applied in a direction illustrated by an arrow A. Accordingly, the pick-up guide 103 is urged such that the tip end 103*c* of the pick-up guide 103 can contact the outer circumference of the roll paper. In some embodiments, the pick-up guide 103 is always urged such that the tip end 103*c* of the pick-up guide 103 is contacting the outer circumference of the roll paper. A desirable load of the urging spring 104 to urge the tip end 103*c* of the pick-up guide 103 is understood to be a load having a strength within a range of strengths such that contact evidence of the tip end 103*c* of the pick-up guide 103 does not remain on the outer circumference of the roll paper.

Figure 4:
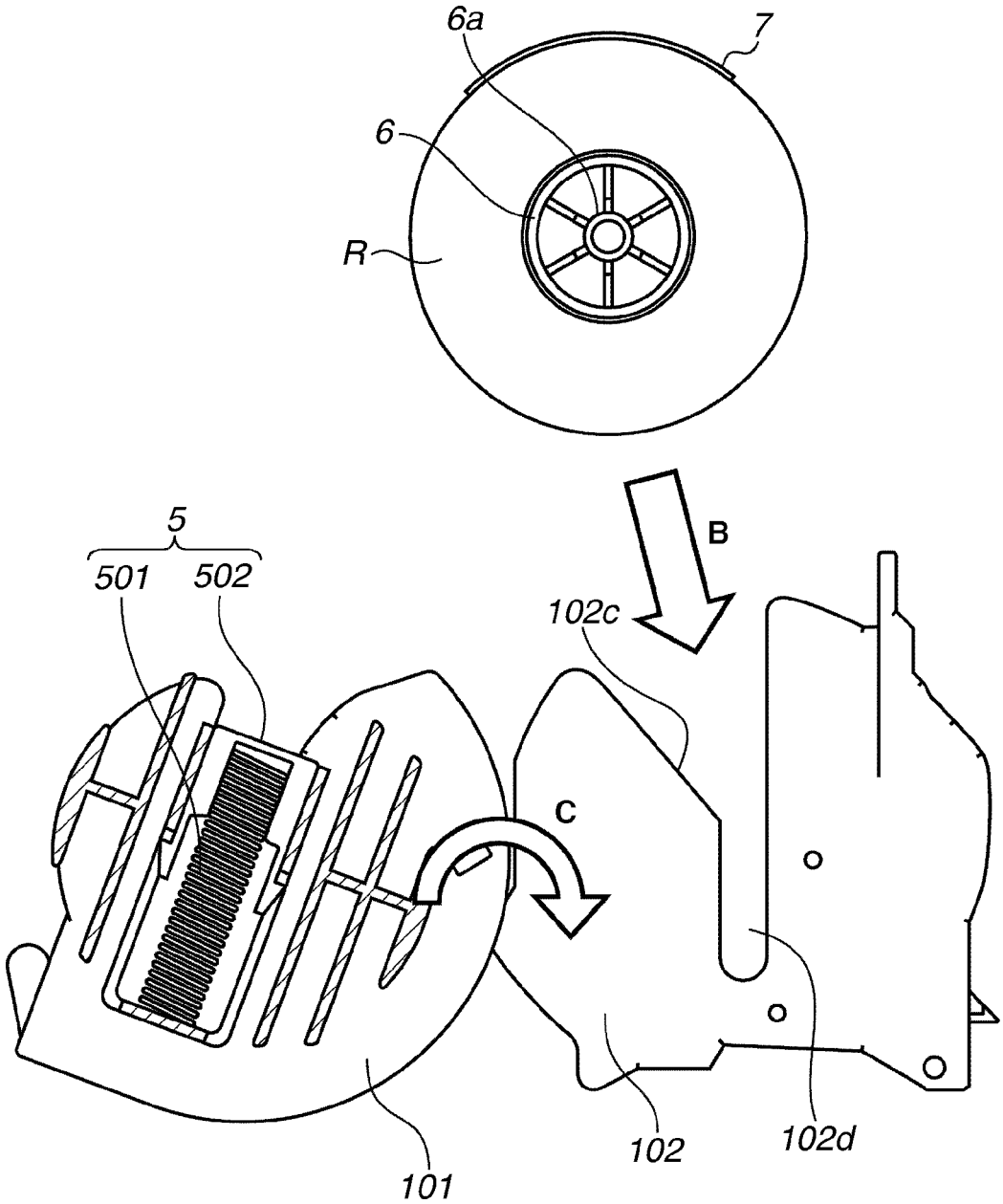
FIG. 4 is a cross sectional view schematically illustrating a loading direction of the roll paper and a configuration of a roll paper shaft pressurizing mechanism according to the exemplary embodiment of the present invention.

FIG. 4 is a cross sectional view schematically illustrating an open state of the roll paper cassette 1, a loading direction of a roll paper R with respect to the lower case 102, and a configuration of the roll paper shaft pressurizing mechanism 5 according to the exemplary embodiment of the present invention.

The roll paper R is loaded into the lower case 102 of the roll paper cassette 1 while the roll paper cassette 1 is open. The roll paper R is provided with a roll paper leading edge fixing seal 7 such that the leading edge of the roll paper R does not open up before the roll paper R is loaded. A roll paper shaft 6 is preliminary inserted into the roll paper R, and the roll paper R with the roll paper shaft 6 is loaded into the lower case 102 from a direction illustrated by an arrow B. Side walls 102*e* are provided on a right side and a left side of the lower case 102 in order to control a width direction of the roll paper R. The respective side walls 102*e* are provided with an inclined surface 102*c*, so that the roll paper R and the roll paper shaft 6 can be loaded with ease. Both end portions 6*a* of the roll paper shaft 6 are engaged with a roll paper shaft control grooves 102*d* provided on the side walls 102*e* of the lower case 102, so that moving directions of the roll paper R and the roll paper shaft 6 are controlled in a direction toward the paper feeding roller 4. Even in a case where the roll paper R remains only by a small amount, the roll paper shaft 6 moves in parallel so as to come closer to a side of the paper feeding roller 4.

After loading the roll paper R, the user removes the roll paper leading edge fixing seal 7 provided on the roll paper R and closes the upper case 101 in a direction of an arrow C. The roll paper shaft pressurizing mechanism 5 is provided on the upper case 101. With the mechanism 5, the roll paper shaft 6*a* is pressurized and restrained in an appropriate position, relative to the upper case 101 and lower case 102. The roll paper pressurizing mechanism 5 may at least include a roll paper pressurizing spring 501 and a roll paper shaft pressurizing guide 502 and is positioned at two portions, i.e., a right portion and a left portion, of the upper case 101 such that the two portions are positioned corresponding to positions of the roll paper both end portions 6*a* when the upper case 101 is closed. The roll paper R can be effectively pressurized (i.e. at least restrained by a force) with the configuration that a line connecting a center of the paper feeding roller 4 and a center of a roll paper core 6 overlaps a vector of a force of the roll paper pressurizing mechanism 5.

When the user closes the upper case 101, the roll paper shaft both ends 6*a* and the roll paper shaft pressurizing guide 502 are pushed into and, therefore, the roll paper shaft pressurizing spring is compressed, resulting in pressurizing the roll paper R in a direction toward the paper feeding roller 4. When the upper case 101 is completely closed, the upper case 101 and the lower case 102 are locked to each other with a case locking mechanism (not shown), thereby controlling the upper case 101 and the lower case 102 so as not to open.

Figure 5A:
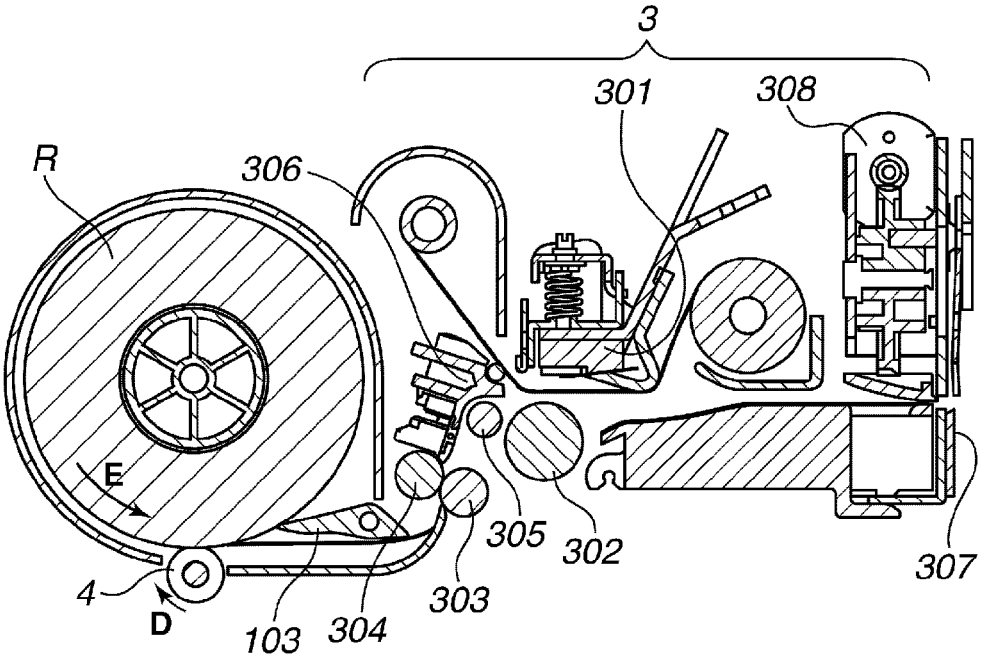
FIGS. 5A and 5B are a cross sectional view of a printer main body upon feeding the roll paper according to the exemplary embodiment of the present invention.
Figure 5B:
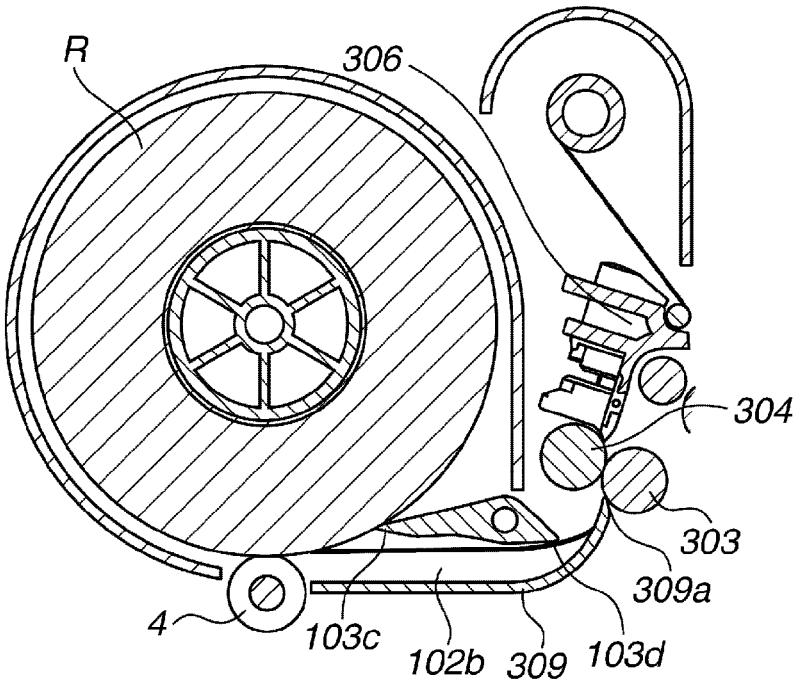

FIG. 5A is a cross sectional view of the printer main body 3 according to the exemplary embodiment of the present invention during feeding the roll paper. FIG. 5B is an enlarged view of the paper feeding unit.

A main configuration of the printer main body 3 is described below with reference to FIG. 5A. The ink ribbons and the roll paper R are brought into a press-contact state by a thermal head 301 and a platen roller 302. The thermal head 301 partially heats the roll paper based on image data to transfer the inks onto the roll paper R to print an image. A pair of conveyance rollers, each including a grip roller 303 and a pinch roller 304, pinches the roll paper R to convey the roll paper R with accuracy.

As a de-curling mechanism of the roll paper R, a conveyance path that curves opposite to an initial curling direction of the roll paper R is used. Since a tensile force is applied to the roll paper R during printing, the curling of the roll paper R can be corrected effectively by causing the roll paper R to pass through the conveyance path that curves opposite to the curling direction of the roll paper R. In the present exemplary embodiment, a decurl roller 305 and a decurl guide 306 are used as the decurling mechanism to guide the roll paper R and reducing the conveyance resistance thereof.

Since the roll paper R is used, a cutter 307 for cutting a printed product and/or a print margin portion and a cutter motor 308 for driving the cutter 307 are provided. In the present exemplary embodiment, the above described components are arranged closer to each other to reduce the overall size of the printer, and all the parts of each of the roll paper cassette 1 and the ink ribbon cassette 2 are arranged such that a projected area of the parts enclosed by a rectangular configuration becomes smaller.

FIG. 5A illustrates a state that the roll paper R in situ and the paper feeding roller 4 press-contacts the roll paper R for feeding the roll paper R. The roll paper R rotates in an arrow E direction (i.e., in a counterclockwise direction) according to a rotation of the paper feeding roller 4 in an arrow D direction (i.e., in a clockwise direction) by a motor force (not shown). The leading edge of the outermost circumference of the roll paper R is picked up (i.e. guided and directed) by the pick-up guide 103 and conveyed from the roll paper cassette 1 to the printer main body 3.

A position of the leading edge of the roll paper R, when the roll paper R remains, is described below with reference to FIG. 5B. The tip end of the pick-up guide 103 contacts the outermost circumference of the roll paper R and the leading edge of the roll paper R is scooped up (i.e. guided away from the paper roll R) and conveyed toward the cassette exit 102*b*. When the roll paper R remains, an outer diameter of the roll paper R is large and the curling degree (i.e. an amount of curling that may be affected by the diameter of the paper roll R) of the roll paper R is small. Therefore, the leading edge of the roll paper R picked up by the pick-up guide 103 travels in about a straight line and is guided by the paper guide 309.

The paper guide 309 is provided for guiding the roll paper R from the paper feeding roller 4 to the grip roller 303. In order to guide the leading edge of the roll paper R to travel smoothly toward the grip roller 303, a position of the tip end 309*a* of the paper guide 309 is important and the position is desirably as close as possible to the grip roller 303.

Since the picked-up portion of the roll paper R curves, the leading edge of the roll paper R travels to a side of the grip roller 303 and is pinched between the grip roller 303 and the pinch roller 304. The grip roller 303 is provided with a projection extending to a radial direction. The roll paper R is conveyed by being pressed against the grip roller 303 and punctured by a projection (not shown) provided on a surface of the grip roller 303, thereby realizing the high conveyance ability. The paired grip roller 303 and pinch roller 304 mainly performs conveyance of the roll paper R during printing. Since the paper feeding roller 4 is made of rubber, the paper feeding roller 4 may slightly slip on the roll paper R.

When the pick-up guide 103 conveys a first sheet, the tip end of the pick-up guide 103 fully comes down (i.e., the leading edge 103 comes closer to a side of the lower case). As the number of sheets increases, the outer diameter of the roll paper R becomes smaller and the tip end of the pick-up guide 103 gradually comes up (i.e., the tip end 103*c* comes closer to a shaft direction of the roll paper R). A downstream side (i.e., a rear end 103*d* of the pick-up guide 103) of the rotational center keeps the conveyance path wider without actively control the roll paper R. Therefore, the roll paper R that is initially used is only slightly curled has a less conveyance resistance, resulting in an easier travel of the roll paper R.

If the remaining amount of the roll paper R becomes such that the diameter of the paper roll R is sufficiently small so the rear end 103*d* of the pick-up guide 103 contacts the lower case 102, the roll paper R cannot be discharged. Therefore, in order to secure the conveyance path even in a case that the remaining amount is smaller, a shape of the pick-up guide 103 and a position of the rotation center may be set such that the rear end 103*d* of the pick-up guide 103 does not contact the lower case 102. Alternatively, it is conceivable that a member for controlling the rotation of the pick-up guide 103 be provided so that the rear end 103*d* of the pick-up guide 103 does not come closer to the lower case 102 by a predetermined distance.

Figure 6:
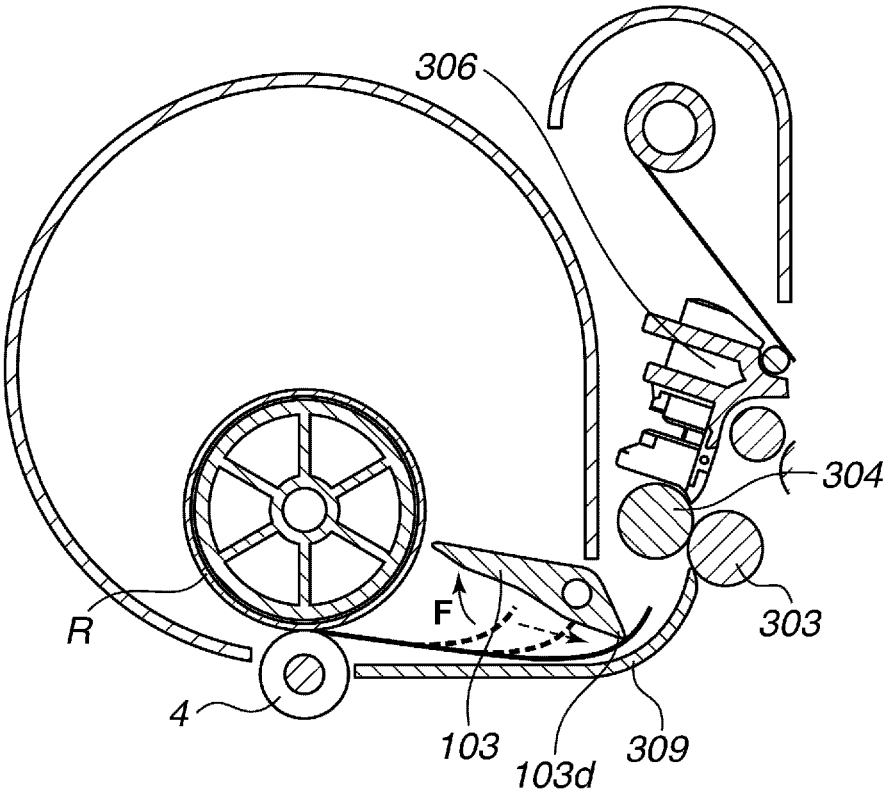
FIG. 6 is an enlarged cross sectional view of a paper feeding unit of the printer main body upon feeding the roll paper according to the exemplary embodiment of the present invention.

FIG. 6 is an enlarged cross sectional view of the paper feeding unit, during feeding the roll paper R, of the printer main body 3 according to the exemplary embodiment of the present invention. More specifically, FIG. 6 illustrates a configuration wherein the remaining amount of the roll paper R has become smaller.

The pick-up guide 103 rotates from the position illustrated in FIGS. 5A and 5B according to the remaining amount of the roll paper R. As illustrated, the pick-up guide 103 moves (i.e. rotates) to a and contacts the outer circumference of the roll paper R or moves such that that a portion of the pick-up guide 103 is controlled by the lower case 102 causing the tip end of the pick-up guide 103 to come closer to the outer circumference of the roll paper R. When the remaining amount of the roll paper R is smaller, the outer diameter of the roll paper R is smaller and the curling degree of the roll paper R is larger. If the curling degree is larger, the leading edge of the roll paper R picked up by the pick-up guide 103 tends to travel toward an upper direction in FIG. 6, resulting in traveling along the pick-up guide 103.

As illustrated in FIG. 6, the leading edge of the roll paper R passes through the rear end 103*d* of the pick-up guide 103 and the roll paper R travels with a curvature while being brought into contact with the rear end 103*d* of the pick-up guide 103. The paper roll R is pinched by the grip roller 303 and the pinch roller 304. In the present exemplary embodiment, the maximum curling degree may at least correspond to an inner diameter of the roll paper R. A top of the rear end 103*d* of the pick-up guide 103 is provided so that the leading edge of the roll paper R is not guided upwardly of the pinch roller 304. This may be the case even with the described curvature. However, in a case where the curling degree is smaller than that considered, or in a case where the distance between the pick-up guide 103 and the pinch roller 304 can be made closer, a setting range of the top of the rear end 103*d* of the pick-up guide 103 can be wider. If there is no problem in the conveyance load of the roll paper R, the rear end 103*d* of the pick-up guide 103 can be set in a direction the roll paper R is controlled.

If the remaining amount of the roll paper R is larger with the above described configuration, the conveyance path near the pick-up guide 103 can be generally made wider to reduce the conveyance load of the roll paper R that is less curled. A convex portion may be provided so the rear end 103*d* of the pick-up guide 103, in a downstream side of the rotational center, narrows the conveyance path when the remaining amount of the roll paper R is reduced and the tip end of the pick-up guide 103 rotates in a direction for widening the roll paper conveyance path with the progress of the printing. The rear end 103*d* of the pick-up guide 103 projects at a position for controlling the roll paper R. Therefore, the leading edge of the roll paper R having a larger curling degree is guided to a lower position to enable the conveyance of the roll paper R to the pinch roller 304.

As described above, according to the present invention, by utilizing the rotation of the pick-up guide 103 as the remaining amount of the roll paper R reduces, the curling up of the roll paper R is controlled in the downstream side of the rotational center of the pick-up guide 103. As the remaining amount of the roll paper R reduces at a side of the tip end of the pick-up guide 103, the pick-up guide 103 rotates in a direction that the conveyance path of the roll paper R becomes wider. Thus, the rear end 103*d* of the pick-up guide 103 that is the tip end of the other side of the tip end 103*c* of the pick-up guide 103 moves in a direction that the conveyance path becomes narrower and the conveyance path formed by the end portion of the pick-up guide 103 of the downstream side of the rotational center becomes narrower. Accordingly, the roll paper can be smoothly conveyed through the pick-up guide to the printer main body mechanism and the downsizing of the printer can be realized by enabling the closer arrangement of the paper feeding mechanism and the print mechanism.

Figure 7:
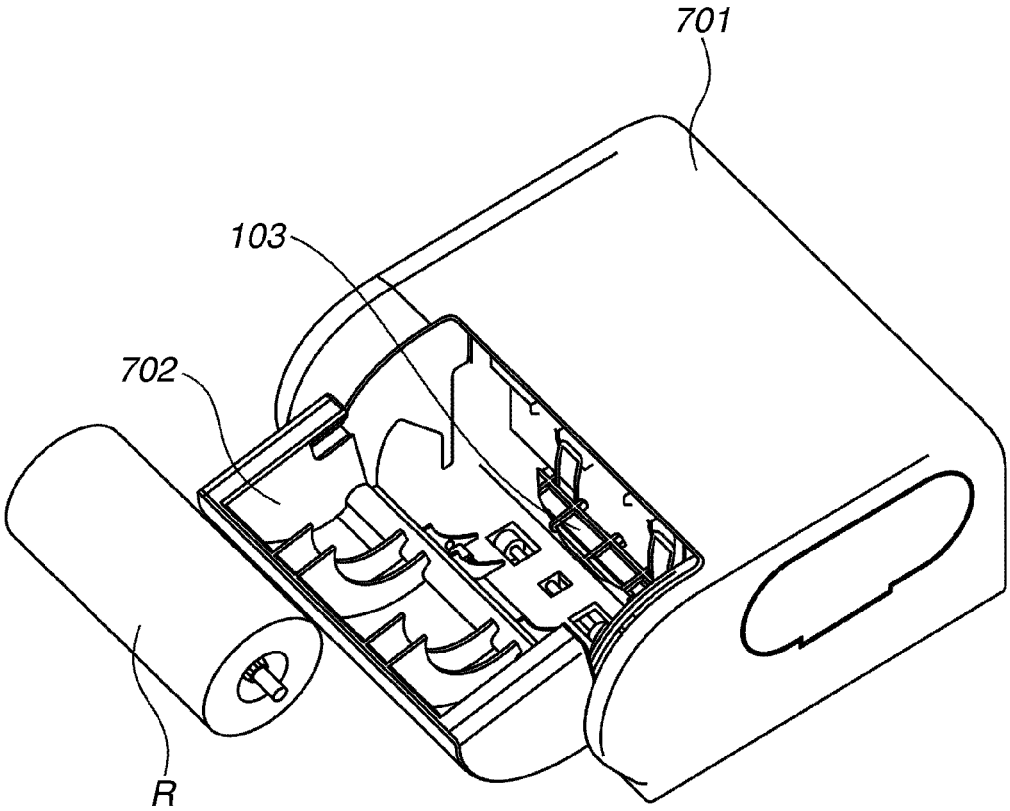
FIG. 7 is a perspective view of a printer in a case where the roll paper is directly loaded into the printer main body without using a roll paper cassette in the exemplary embodiment of the present invention.
Figure 8A:
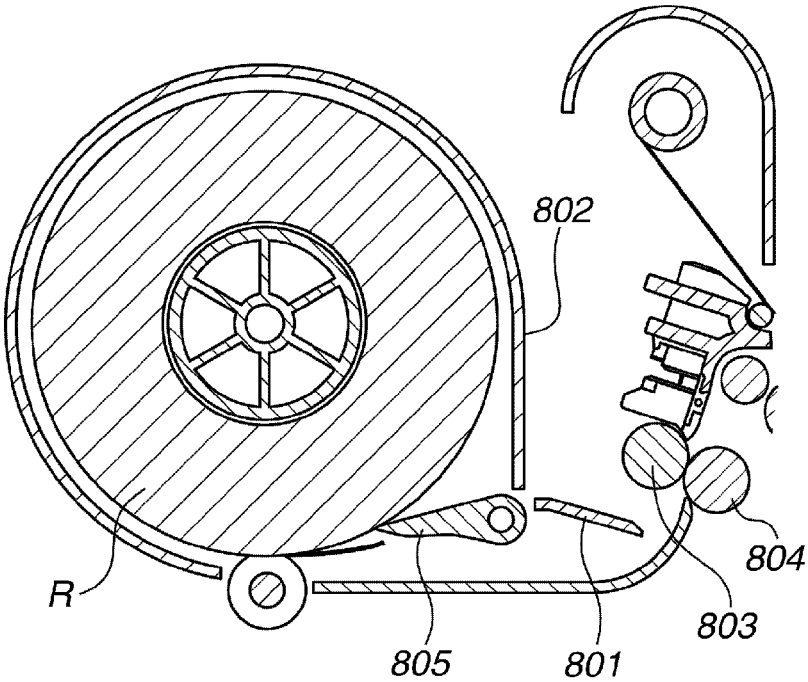
FIGS. 8A and 8B are a cross sectional view of a paper feeding unit illustrating the conventional problem.
Figure 8B:
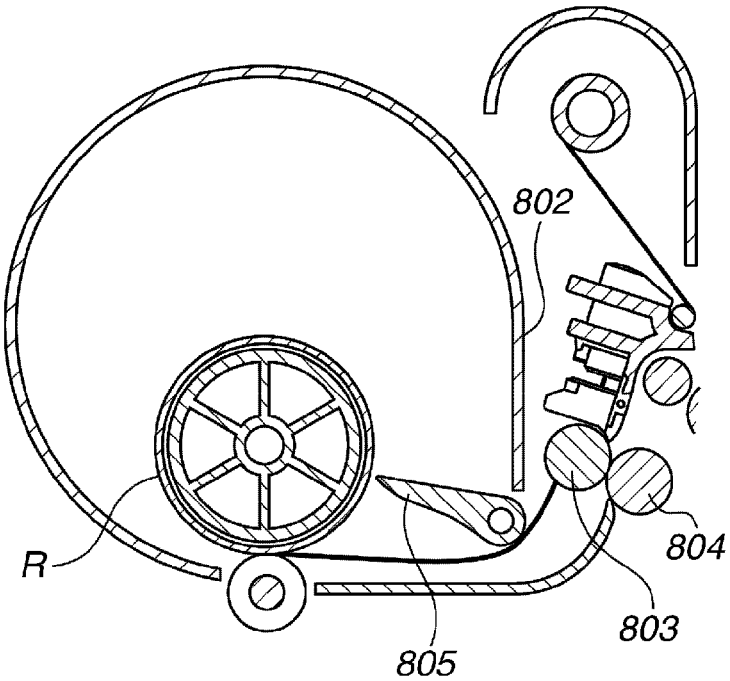

Hereinbefore, a preferred exemplary embodiment of the present invention is described. However, a similar effect may be produced by using the roll paper cassette 1 as illustrated in FIG. 7 and, instead of providing the pick-up guide 103 on the roll paper cassette 1, by providing the pick-up guide 103 on a side of the main body. Alternatively, with an open-close lid 702 provided on the printer main body 701, the roll paper R may be directly loaded into the printer main body 701.

The present invention is not limited to these exemplary embodiments but various modifications and changes can be made without departing from the spirit and the scope of the invention. Further, the present invention may also be applicable to a case where a roll paper is used in a paper feeding mechanism such as an ink jet printer and a laser printer in addition to a sublimation printer. Although a greater effect can be produced in a case where the paper feeding conveyance path curves in the downstream of the pick-up guide, the variation in the positions of the leading edge of the roll paper generated by curling of the roll paper can be reduced in a case where the paper feeding conveyance path is configured horizontally.

While the present invention has been described with reference to exemplary embodiments, it is to be understood that the invention is not limited to the disclosed exemplary embodiments. The scope of the following claims is to be accorded with the broadest interpretation to encompass all modifications, equivalent structures, and functions.

This application claims priority from Japanese Patent Application No. 2010-170798 filed Jul. 29, 2010, which is hereby incorporated by reference herein in its entirety.

What is claimed is:

1. A feeding apparatus, comprising: an accommodating unit configured to accommodate roll paper;

a pick-up guide configured to pick up a leading edge of the roll paper by contacting an outer circumference of the roll paper;

an urging unit configured to urge a tip end of the pick-up guide in a direction that the tip end contacts the outer circumference of the roll paper, wherein the tip end is arranged between the outer circumference of the roll paper and the leading edge of the roll paper; and a feeding unit configured to cause the roll paper to rotate, so that the leading edge of the roll paper picked up with the pick-up guide and the roll paper is fed from the accommodating unit, wherein the pick-up guide rotates as an outer diameter of the roll paper becomes smaller according to a remaining amount of the roll paper, and a rear end of the pick-up guide moves in a direction to narrow a conveyance path of the roll paper picked up by the pick-up guide, wherein an amount of rotation of the pickup guide is controlled by a size of the outer circumference of the roll paper, and wherein the pick-up guide pivots about a shaft, the shaft being arranged between the tip end of the pick-up guide and a rear end of the pick-up guide, and a top of the rear end is shaped such that the leading edge of the roll paper moves along the conveyance path.

2. The feeding apparatus according to claim 1, wherein the feeding unit includes a feeding roller and rotationally drives the feeding roller to cause the roll paper urged against a side of the feeding roller to rotate.

3. The feeding apparatus according to claim 1, further comprising:

a pair of conveyance rollers configured to convey the roll paper fed from the accommodating unit, wherein the pair of conveyance rollers are provided in the conveyance path at a position that is downstream from the pick-up guide.

4. The feeding apparatus according to claim 1, wherein the conveyance path of the roll paper fed from the accommodating unit curves in a curling direction of the roll paper.

5. The feeding apparatus according to claim 1, further comprising a control unit configured to control a rotation of the pick-up guide.

6. The feeding apparatus according to claim 1, wherein the accommodating unit is detachably attached to the feeding apparatus.

7. The feeding apparatus according to claim 6, wherein the accommodating unit is detachably attached in a direction that is orthogonal to a conveyance direction during feeding the roll paper by the feeding unit.

8. The feeding apparatus according to claim 6, wherein the pick-up guide is provided on the detachable accommodating unit.

9. The feeding apparatus according to claim 1, further comprising a printing unit configured to print an image on the roll paper fed from the accommodating unit by the feeding unit.

10. The feeding apparatus according to claim 9, further comprising a decurling unit which is arranged between the printing unit and the conveyance roller and is configured to correct curling of the roll paper, wherein, in the decurling unit, the conveyance path curves in a direction opposite to curling of the rolling paper.

11. A feeding apparatus, comprising:

an accommodating unit configured to accommodate roll paper;

a rotatable pick-up guide configured to pick up a leading edge of the roll paper by contacting an outer circumference of the roll paper;

an urging unit configured to urge a tip end of the pick-up guide in a direction that the tip end contacts the outer circumference of the roll paper, wherein the tip end is arranged between the outer circumference of the roll paper and the leading edge of the roll paper; and a feeding unit configured to pick up the leading edge of the roll paper with the pick-up guide and to feed the roll paper from the accommodating unit by rotating the roll paper, wherein the pick-up guide rotates as an outer diameter of the roll paper becomes smaller according to a remaining amount of the roll paper and a rear end of the pick-up guide moves to control a conveyance path of the roll paper, wherein an amount of rotation of the pick-up guide is controlled by a size of the outer circumference of the roll paper, and wherein the pick-up guide pivots about a shaft, the shaft being arranged between the tip end of the pick-up guide and a rear end of the pick-up guide, and a top of the rear end is shaped such that the leading edge of the roll paper moves along the conveyance path.

* * * * *